US008062041B2

(12) United States Patent
Nakamura

(10) Patent No.: US 8,062,041 B2
(45) Date of Patent: Nov. 22, 2011

(54) CONNECTOR

(75) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 164 days.

(21) Appl. No.: 12/462,929

(22) Filed: Aug. 11, 2009

(65) Prior Publication Data

US 2010/0062650 A1 Mar. 11, 2010

(30) Foreign Application Priority Data

Sep. 11, 2008 (JP) ..... 2008-233643

(51) Int. Cl.
*H01R 13/648* (2006.01)

(52) U.S. Cl. ..... 439/108; 439/660; 439/948

(58) Field of Classification Search ..... 439/108, 439/660, 948, 924.1
See application file for complete search history.

(56) References Cited

U.S. PATENT DOCUMENTS 3,530,422 A * 9/1970 Goodman ..... 439/62
4,042,289 A * 8/1977 Heinonen et al. ..... 439/629
4,133,592 A * 1/1979 Cobaugh et al. ..... 439/74
5,108,311 A * 4/1992 Nakazawa ..... 439/607.32
5,195,899 A * 3/1993 Yatsu et al. ..... 439/101
5,360,349 A 11/1994 Provencher et al.

FOREIGN PATENT DOCUMENTS

JP 07-006810 1/1995
JP 08-078079 3/1996

OTHER PUBLICATIONS

Japanese Office Action dated Jun. 17, 2010 along with an English translation of same.

* cited by examiner

*Primary Examiner* — Xuong Chung Trans
(74) *Attorney, Agent, or Firm* — Collard & Roe, P.C.

(57) ABSTRACT

A connector has a mating surface on which the connector is mated with a mating connector in a first direction. The connector includes a power supply contact and a housing. The housing is formed with a power supply contact holder and a protrusion. The power supply contact holder holds the power supply contact. The protrusion extends along the first direction to a location closer to the mating surface than an edge of the power supply contact. The protrusion extends along a second direction perpendicular to the first direction more than the power supply contact within the power supply contact holder.

6 Claims, 4 Drawing Sheets

CONNECTOR

CROSS REFERENCE TO RELATED APPLICATIONS

Applicant claims priority under 35 U.S.C. §119 of Japanese Patent Application No. JP2008-233643 filed Sep. 11, 2008.

BACKGROUND OF THE INVENTION

The present invention relates to a connector including a power supply contact having a relatively large size.

Some connectors have power supply contacts for supplying electric power in addition to signal contacts and ground contacts. Generally, power supply contacts have a size larger than signal contacts and the like in order to prevent an extreme voltage drop in the power supply contacts.

Various precautions have been taken to prevent an operator using a connector from receiving an electric shock or getting burnt by touching a power supply contact due to its large size. For example, JP A 08-078079 discloses an example of a connector having a cylindrical power supply contact with an insulator covering a tip of the power supply contact and an insulating pin provided inside of the power supply contact to prevent a finger from entering an internal space of the cylindrical power supply contact and touching the power supply contact although the illustrated connector does not have signal contacts.

However, a finger may touch a power supply contact by accident even if the power supply contact is not so large that the finger enters an internal space of the cylindrical power supply contact. The technology disclosed in JP A 08-078079 cannot cope with such a case.

Furthermore, if the insulator covering the tip of the power supply contact disclosed in JP A 08-078079 is made thinner, it may be broken when the connector is detached from a mating connector. On the other hand, if the insulator is made thicker, the size of the connector problematically increases. Additionally, it is not easy to cover a contact with an insulator, and the workability of the covering process is not so good.

SUMMARY OF THE INVENTION

It is an object of the present invention to provide a connector capable of preventing a finger or the like from touching a power supply contact in a different way than the technology disclosed in JP A 08-078079.

One aspect of the present invention provides a connector has a mating surface on which the connector is mated with a mating connector in a first direction. The connector includes a power supply contact and a housing. The housing is formed with a power supply contact holder and a protrusion. The power supply contact holder holds the power supply contact holder. The protrusion extends along the first direction to a location closer to the mating surface than an edge of the power supply contact. The protrusion extends along a second direction perpendicular to the first direction more than the power supply contact within the power supply contact holder.

Another aspect of the present invention provides a mating connector to be mated with the above connector. The mating connector has a mating power supply contact for connection with the power supply contact of the connector. The mating power supply contact includes two contact points slidable on the power supply contact in such a state that the protrusion of the connector is interposed between the two contact points along a third direction perpendicular to both of the first direction and the second direction when the connector is mated with the mating connector.

An appreciation of the objectives of the present invention and a more complete understanding of its structure may be had by studying the following description of the preferred embodiment and by referring to the accompanying drawings.

Figure 1:
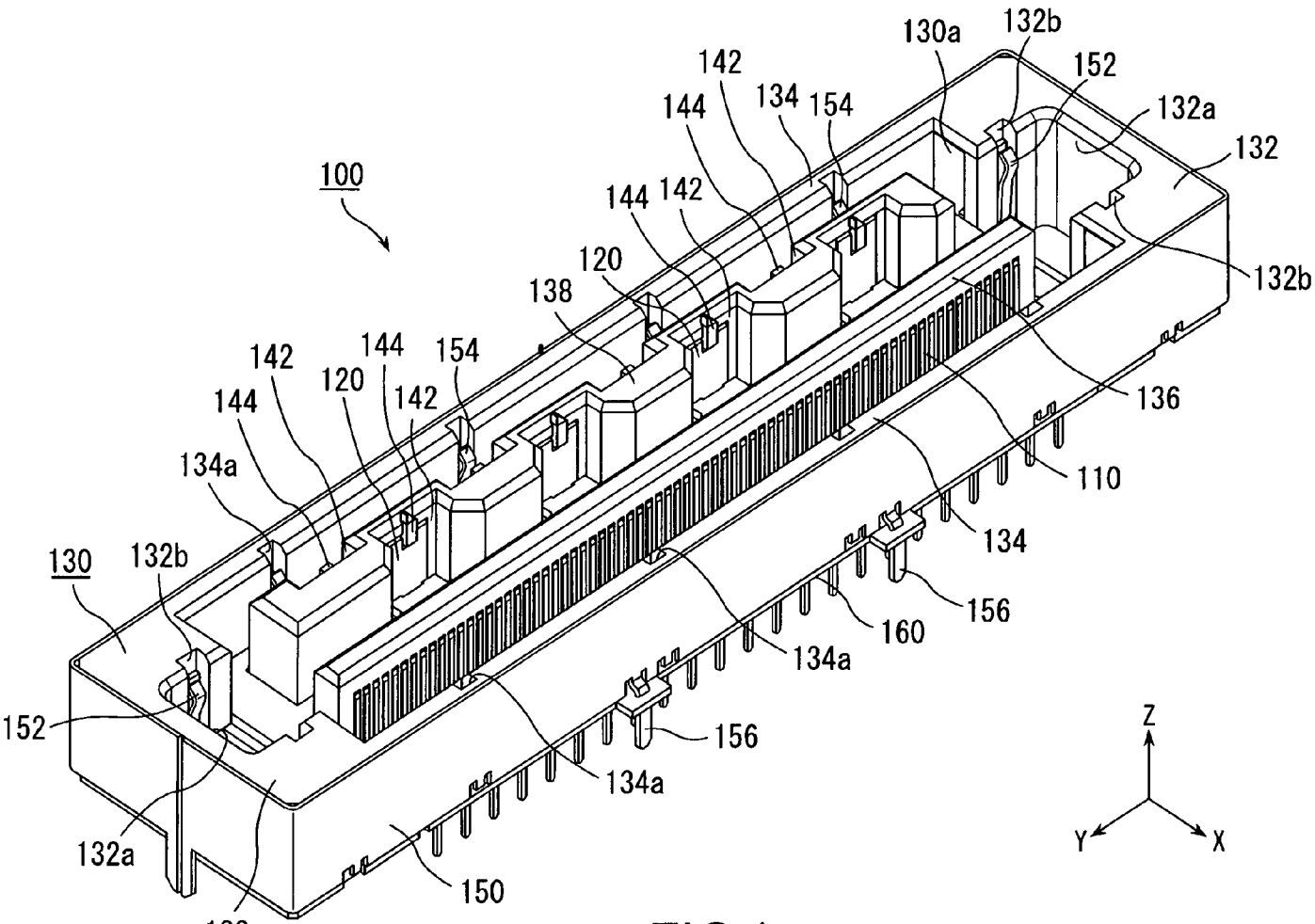
FIG. 1 is a perspective view showing a receptacle connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

A connector assembly according to an embodiment of the present invention is used to connect between circuit boards (objects to be connected). The connector assembly includes a receptacle connector (connector) 100 shown in FIGS. 1 to 3 and a plug connector (mating connector) 200 shown in FIGS. 4 and 5.

As can be seen from FIG. 1, the receptacle connector 100 is mated with the plug connector 200 on a mating surface of a front end of the receptacle connector 100 inserted in the Z-direction (first direction). The receptacle connector 100 has short sides along the X-direction (second direction) and long sides along the Y-direction (third direction). The receptacle connector 100 of the present embodiment includes signal contacts 110, power supply contacts 120, a housing 130 for holding the signal contacts 110 and the power supply contacts 120, a shell 150 covering the housing 130, a support substrate 160 located on a bottom of the housing 130 for supporting the signal contacts 110 and the like.

Figure 2:
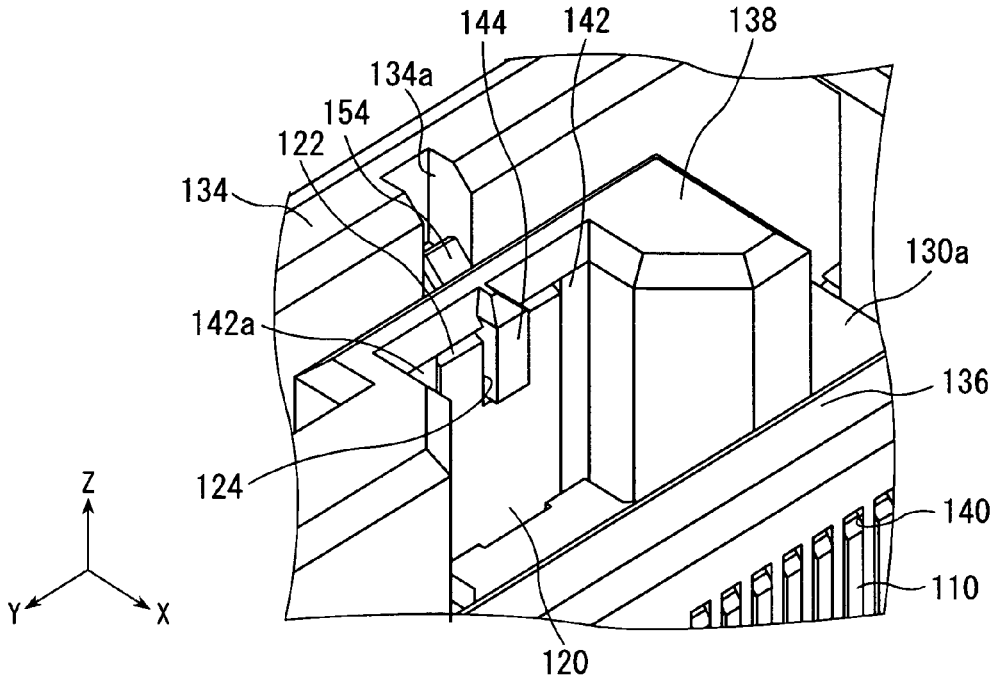
FIG. 2 is an enlarged perspective view showing power supply contacts and the vicinity of the power supply contacts in the receptacle connector of FIG. 1.

As shown in FIGS. 1 and 2, each of the power supply contacts 120 is in the form of a plate and has a contact surface thereon for connection with the plug connector 200. Each of the power supply contacts 120 has a size larger than that of the signal contacts 110. Particularly, as shown in FIG. 2, each of the power supply contacts 120 has an edge 122 with a notch 124 extending from the edge 122 toward the negative Z-direction.

As shown in FIG. 1, the housing 130 has two ends 132 in the Y-direction. The housing 130 also has two sidewalls 134 connecting those ends 132 to each other. The ends 132, the sidewalls 134, and the bottom of the housing 130 define a receptacle portion 130*a*, which is recessed in the negative Z-direction. Each of the ends 132 has a recessed portion 132*a* recessed in the positive Y-direction or the negative Y-direction. Each of the recessed portions 132*a* has grooves 132*b* formed on both of side surfaces extending along the Y-direction for holding contact portions. Those grooves 132*b* are recessed in the positive X-direction or the negative X-direction. Furthermore, each of the sidewalls 134 has grooves 134*a* recessed in the positive X-direction or the negative X-direction for holding contact portions.

As shown in FIG. 1, the receptacle connector 100 has a first land 136 and a second land 138 formed in the receptacle portion 130*a* of the housing 130. Each of the lands 136 and 138 projects from the bottom of the housing 130 in the positive Z-direction and extends along the Y-direction. As shown in FIG. 2, the first land 136 has signal contact holders 140 formed in both of side surfaces extending along the Y-direction for holding the signal contacts 110. The second land 138 has power supply contact holders 142 formed in both of side surfaces extending along the Y-direction for holding the power supply contacts 120. Each of the power supply contact holders 142 of the present embodiment is formed by a groove recessed in the positive X-direction or the negative X-direction. The power supply contact 120 is disposed on a bottom 142*a* of the groove.

Figure 3:
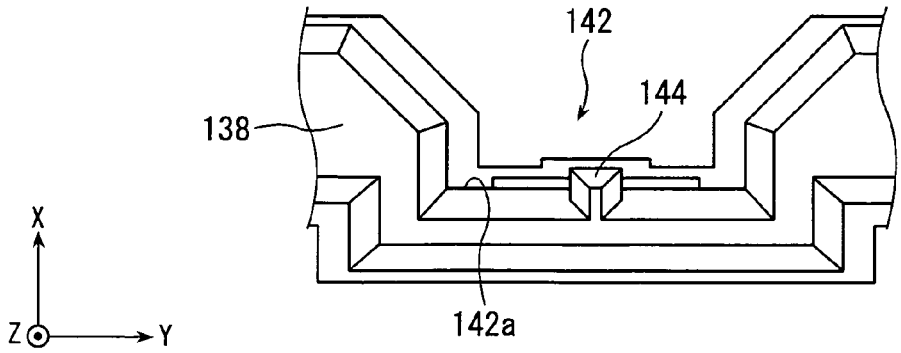
FIG. 3 is an enlarged plan view showing a contact holder of a housing in the receptacle connector of FIG. 1.

As shown in FIGS. 1 to 3, the second land 138 of the housing 130 has protrusions 144 respectively formed on the power supply contact holders 142. Each of the protrusions 144 extends along the Z-direction to a location closer to the mating surface of the receptacle connector 100 than the edge 122 of the power supply contact 120. Furthermore, each of the protrusions 144 extends from the bottom 142*a* of the power supply contact holder 142 along the positive X-direction or the negative X-direction more than the power supply contact 120. More specifically, each of the protrusions 144 is arranged such that a portion of the protrusion 144 is positioned within the notch 124 of the power supply contact 120.

As shown in FIG. 1, the shell 150 covers the housing 130 in the X-direction and the Y-direction and includes a plurality of shell contact portions 152 and 154 and a plurality of shell terminal portions 156. Those portions 152, 154, and 156 are formed by bending a base material. The shell contact portions 152 and 154 are used to establish connection with a mating shell of the plug connector 200, which will be described later. The shell contact portions 152 are received within the grooves 132*b* in such a state that they extend along the Z-direction and slightly project into the recessed portion 132*a*. The shell contact portions 154 are received within the grooves 134*a* in such a state that they extend along the Z-direction and slightly project into the receptacle portion 130*a*. The shell terminal portions 156 are connected to a substrate (not shown), which is an object to be connected to the receptacle connector 100. In the present embodiment, the shell terminal portions 156 extend toward the negative Z-direction via the support substrate 160.

As described above, the receptacle connector 100 of the present embodiment has protrusions 144 each extending along two directions of the positive Z direction and the positive X-direction or the negative X-direction more than the power supply contact 120. Therefore, a finger of an operator using the receptacle connector 100 is prevented from touching the power supply contacts 120.

Figure 4:
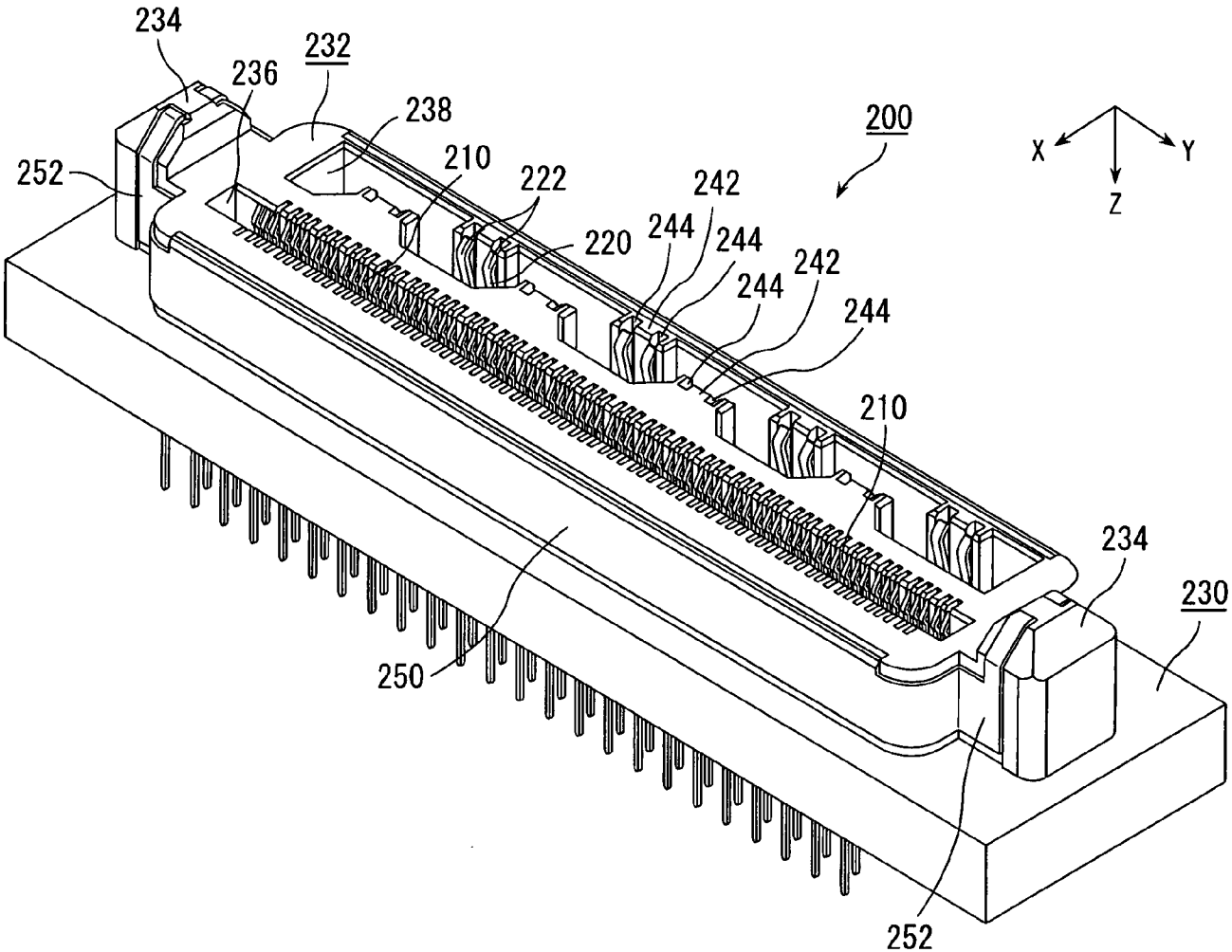
FIG. 4 is a perspective view showing a plug connector according to the embodiment of the present invention.

As shown in FIG. 4, the plug connector 200 as a mating connector to be mated with the receptacle connector 100 has mating signal contacts 210, mating power supply contacts 220, a mating housing 230 for holding the mating signal contacts 210 and the mating power supply contacts 220, and a mating shell 250 attached to the mating housing 230.

Figure 5:
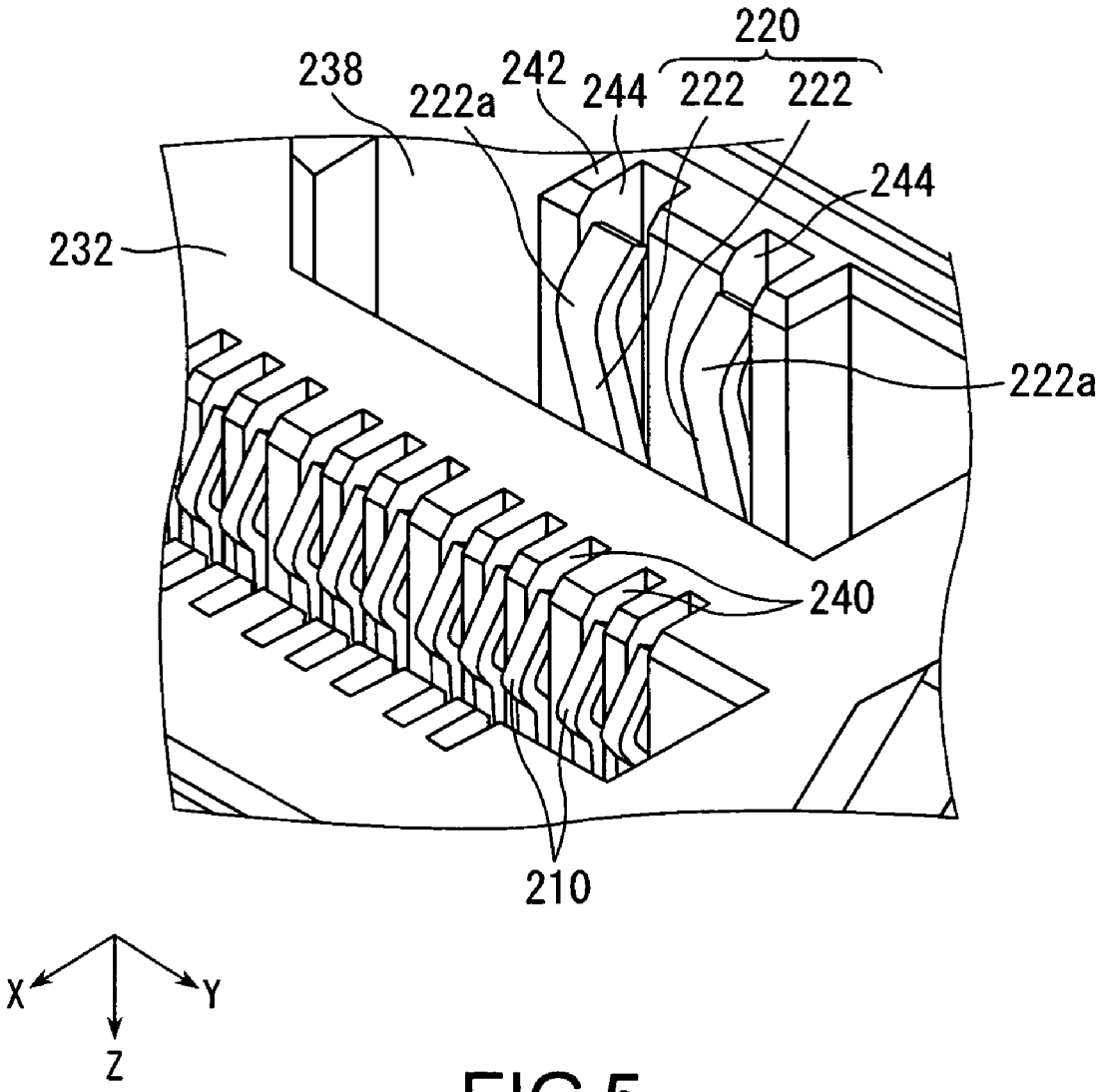
FIG. 5 is an enlarged perspective view showing mating power supply contacts and the vicinity of the mating power supply contacts in the plug connector of FIG. 4.

As shown in FIGS. 4 and 5, each of the mating power supply contacts 220 of the present embodiment includes two contact members 222 bent into a mountainous shape having the highest point 222*a* along the positive X-direction or the negative X-direction. Those highest points 222*a* serve as contact points to be brought into contact with the power supply contacts 120 of the receptacle connector 100. When the plug connector 200 is mated with the receptacle connector 100, those contact points 222*a* slide on the corresponding power supply contact 120 of the receptacle connector 100 in such a state that the corresponding protrusion 144 is interposed between adjacent contact points 222*a* along the Y-direction. Each of the mating power supply contacts 220 may be bifurcated or be formed by a pair of pin contacts as long as it has two contact points 222*a*.

As shown in FIG. 4, the mating housing 230 includes an insert portion 232 received in the receptacle portion 130*a* of the receptacle connector 100 and protrusions 234 extending from the insert portion 232 along the positive Y-direction and the negative Y-direction. Furthermore, the insert portion 232 includes a first receptacle groove 236 and a second receptacle groove 238. The first receptacle groove 236 and the second receptacle groove 238 are used to receive the first land 136 and the second land 138 of the receptacle connector 100 when the plug connector 200 is mated with the receptacle connector 100. As can be seen from FIGS. 4 and 5, mating contact holders 240 are formed in the first receptacle groove 236 for holding the mating signal contacts 210, and mating contact holders 242 are formed in the second receptacle groove 238 for holding the mating power supply contacts 220. Each of the mating contact holders 242 has two holding grooves 244 recessed in the positive X-direction or the negative X-direction. Those holding grooves 244 extend along the positive Z-direction. The contact members 222 of the mating power supply contacts 220 are held in the holding grooves 244 such that the contact points 222*a* can be deformed in the X-direction.

As shown in FIG. 4, the mating shell 250 is attached to the mating housing 230 so as to primarily cover side surfaces of the insert portion 232 extending along the Y-direction. In the present embodiment, the mating shell 250 has ends 252 covering a portion of side surfaces and upper surfaces of the protrusions 234.

In order to mate the plug connector 200 with the receptacle connector 100, the insert portion 232 and the protrusions 234 of the plug connector 200 are inserted into the receptacle portion 130*a* and the recessed portions 132*a* of the receptacle connector 100, respectively. As a result, the shell terminal portions 152 and 154 of the receptacle connector 100 are connected to the mating shell 250 of the plug connector 200. Furthermore, when the plug connector 200 is mated with the receptacle connector 100, the first land 136 and the second land 138 of the receptacle connector 100 are received in the first receptacle groove 236 and the second receptacle groove 238 of the plug connector 200, respectively. As a result, the signal contacts 110 are connected to the mating signal contacts 210, and the power supply contacts 120 are connected to the mating power supply contacts 220. In the plug connector 200 of the present embodiment, two contact points 222*a* spaced in the Y-direction are provided for one power supply contact 120. Therefore, the two contact points 222*a* can slide on the power supply contact 120 in such a state that the corresponding protrusion 144 of the receptacle connector 100 is interposed between the two contact points 222*a* along the Y-direction when the plug connector 200 is mated with the receptacle connector 100. Thus, according to the present embodiment, the plug connector 200 can be mated with the receptacle connector 100 without needs to consider the presence of the protrusions 144 by the same operation as that for a conventional connector assembly.

As described above, according to the present embodiment, a protrusion is formed integrally with a housing so as to extend along two directions in which an operator's finger may possibly touch a power supply contact, more than the power supply contact. Therefore, it is possible to prevent a finger and the like from touching the power supply contact.

Furthermore, since the protrusion is formed on the housing, i.e., formed integrally with the housing, sufficient strength can be provided even if the protrusion has a small size. Accordingly, it is possible to prevent the size of the connector from increasing.

The power supply contacts are used for a power source in the present embodiment. Nevertheless, the power supply contacts may be used not only for a power source, but also for a high voltage, a large current, and the like.

The present application is based on a Japanese patent application of JP2008-233643 filed before the Japan Patent Office on Sep. 11, 2008, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector having a mating surface on which the connector is mated with a mating connector in a first direction, the connector comprising:

a contact having an edge facing the mating surface in the first direction; and a housing formed with a contact holder and a protrusion, the contact holder holding the contact, a part of the protrusion extending along the first direction toward the mating surface of the connector over the edge of the contact, the protrusion extending within the contact holder along a second direction perpendicular to the first direction more than the contact extends along the second direction within the contact holder, wherein the contact has a notch extending from the edge along the first direction, and wherein the protrusion is positioned in part within the notch of the contact.

2. The connector as recited in claim 1, further comprising a signal contact having a size smaller than the contact, wherein the housing is further formed with a signal contact holder holding the signal contact.

3. The connector as recited in claim 1, wherein the contact holder comprises a groove which is recessed in the second direction and has a bottom in the second direction, wherein the contact is disposed on the bottom of the groove of the contact holder, and wherein the protrusion is formed on the bottom of the groove of the contact holder.

4. The connector as recited in claim 1, further comprising a shell covering the housing, the shell including a plurality of shell contact portions for connection with a mating shell of the mating connector and a terminal for connection with the an object to be connected to the connector.

5. The connector as recited in claim 1, wherein the contact is a power supply contact, and wherein the contact holder is a power supply contact holder.

6. A combination of a connector and a mating connector able to be mated with the connector, the connector comprising:

a mating surface on which the connector is mated with a mating connector in a first direction;

a contact having an edge and a notch, the edge facing the mating surface in the first direction, the notch extending from the edge along the first direction; and a housing formed with a contact holder and a protrusion, the contact holder holding the contact, the protrusion being positioned in part within the notch of the contact, a part of the protrusion extending along the first direction toward the mating surface of the connector over the edge of the contact, the protrusion extending within the contact holder along a second direction perpendicular to the first direction more than the contact extends along the second direction within the contact holder;

the mating connector comprising:

a mating power supply contact for connection with the contact of the connector, the mating power supply contact including a first contact point and a second contact point slidable on the contact of the connector, the second contact point being offset from the first contact point in a third direction perpendicular both to the first direction and the second direction so that a space exists between the first contact point and the second contact point in the third direction, the space being able to receive a protrusion of the connector;

wherein when the mating connector is mated with the connector, the protrusion of the connector is interposed between the first contact point of the mating power supply contact and the second contact point of the mating power supply contact in the space between the first contact point and the second contact point.

* * * * *